US010919607B1

(12) United States Patent
Jankowski

(10) Patent No.: US 10,919,607 B1
(45) Date of Patent: Feb. 16, 2021

(54) BUILT-IN SYSTEM FOR TESTING THE SPRINKLER SYSTEM OF A LIFEBOAT

(71) Applicant: Jacek Jankowski, Warsaw (PL)

(72) Inventor: Jacek Jankowski, Warsaw (PL)

( * ) Notice: Subject to any disclaimer, the term of this patent is extended or adjusted under 35 U.S.C. 154(b) by 0 days.

(21) Appl. No.: 16/865,472

(22) Filed: May 4, 2020

(51) Int. Cl.
*B63C 9/02* (2006.01)
*A62C 37/50* (2006.01)

(52) U.S. Cl.
CPC ..... *B63C 9/02* (2013.01); *A62C 37/50* (2013.01)

(58) Field of Classification Search
CPC ..... B63C 9/02; A62C 37/50
See application file for complete search history.

(56) References Cited

U.S. PATENT DOCUMENTS 5,234,320 A * 8/1993 Domenge ..... F04D 9/005 239/587.1
2012/0305260 A1* 12/2012 Paturu ..... E21B 43/0122 166/352

FOREIGN PATENT DOCUMENTS

CN 205396490 * 7/2016 ..... B63C 9/02
CN 205396490 U 7/2016
DE 2527648 6/1975
DE 2527648 12/1976
DE 2527648 A1 * 12/1976 ..... B63C 9/02

* cited by examiner

*Primary Examiner* — S. Joseph Morano
*Assistant Examiner* — Jovon E Hayes
(74) *Attorney, Agent, or Firm* — Neifeld IP Law, PLLC

(57) ABSTRACT

The built-in system for testing the sprinkler system of a lifeboat is characterized in that it has a water tank (17) connected to a pipeline for the water from the water installation of the marine facility (14) which pipeline is equipped with a sprinkler system pump (2). The pipeline for the water from the water installation of the marine facility (14) has a valve for the water from the water installation of the marine facility (15) and is connected to an outboard water inlet pipe of the sprinkler system (4), which pipe has an outboard water valve (5). At a connection point (16), the pipeline for the water from the water installation of the marine facility (14) is connected to the outboard water inlet pipe of the sprinkler system (4). The connection point (16) that connects the pipeline for the water from the water installation of the marine facility (14) to the outboard water inlet pipe of the sprinkler system (4) is located between the outboard water valve (5) of the outboard water inlet pipe of the sprinkler system (4) and the sprinkler system pump (2).

6 Claims, 1 Drawing Sheet

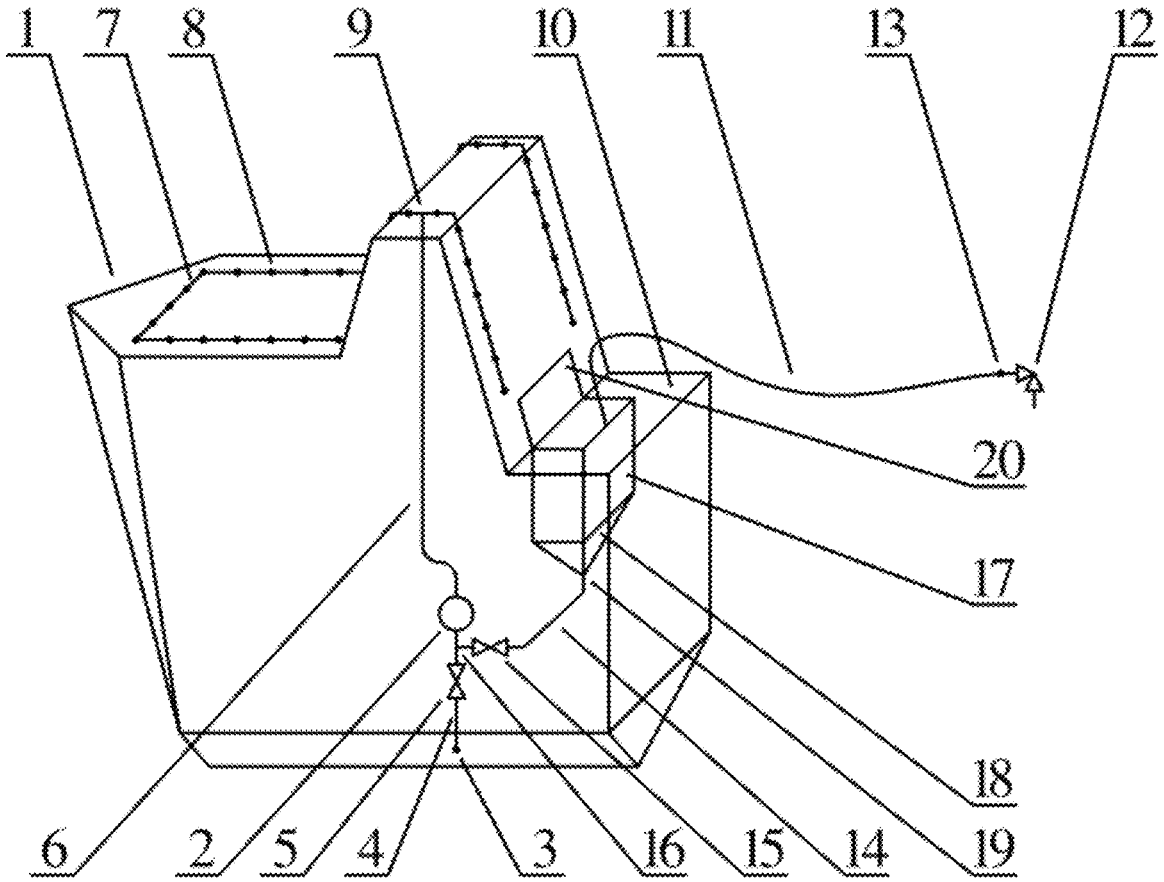
1
7
8
9
10
11
13
12
20
17
18
19
14
15
16
3
4
5
2
6

BUILT-IN SYSTEM FOR TESTING THE SPRINKLER SYSTEM OF A LIFEBOAT

BACKGROUND

Field of the Invention

The subject matter of the invention is a built-in system for testing the sprinkler system of a lifeboat. In particular, the invention can be used on ships and offshore installations.

Discussion of the Background

The lifeboat sprinkler systems known in the art usually include an interconnected: outboard water inlet pipe, water pump, and pipeline whose section outside the lifeboat's hull has sprinkler nozzles. The external pipeline is routed outside the lifeboat's hull in such a way, and has such a number of sprinkler nozzles, as to allow the water from the nozzles to wash the above-water part of the lifeboat's hull in a situation where the lifeboat is traveling over an area of water covered by a burning substance. The water pump is usually an impeller pump that operates by using the rotational motion of the shaft of the lifeboat's running engine.

The sprinkler system also includes a valve with a connector for flushing the sprinkler system with fresh water after a seawater test has been carried out. This valve enables fresh water to flow through the sprinkler system In the currently applied solutions, it is possible to test the sprinkler system by opening the outboard water inlet valve leading to the lifeboat's sprinkler system pump, starting the lifeboat's engine and the sprinkler system pump, and visually evaluating the operation of the sprinkler system.

SUMMARY OF THE INVENTION

Object of the Invention

It is an object of the invention to improve the capabilities for testing of the lifeboat's sprinkler system.

SUMMARY OF THE INVENTION

The invention provides a lifeboat having a water tank and pipe communicating water to a valve in communication with the inlet side of the pump of the sprinkler system.

The essence of the built-in system of the invention for testing the sprinkler system of a lifeboat is that it has a water tank connected to a pipeline for the water from the water installation of the marine facility, which pipeline is equipped with a sprinkler system pump. The pipeline for the water from the water installation of the marine facility has a valve for the water from the water installation of the marine facility and is connected to an outboard water inlet pipe of the sprinkler system, which pipe has an outboard water valve. At a connection point, the pipeline for the water from the water installation of the marine facility is connected to the outboard water inlet pipe of the sprinkler system. The connection point that connects the pipeline for the water from the water installation of the marine facility to the outboard water inlet pipe of the sprinkler system is located between the outboard water valve of the outboard water inlet pipe of the sprinkler system and the sprinkler system pump.

Preferably, the water tank has a top wall, and the top wall of the water tank is a part of the lifeboat's hull plating.

It is good if the top wall of the water tank is openable.

It is best if the lowest point of the bottom of the water tank is connected to the pipeline for the water from the water installation of the marine facility.

Preferably, the top wall of the water tank is located below a connecting point which point connects an internal pipeline of the sprinkler system to an external pipeline of the sprinkler system.

It is good if the bottom of the water tank is located above: the sprinkler system pump, the outboard water inlet pipe of the sprinkler system, and the pipeline for the water from the water installation of the marine facility.

BRIEF DESCRIPTION OF THE DRAWING

FIG. 1 is a schematic view of a lifeboat showing the built-in system for testing the sprinkler system of lifeboat 1.

DETAILED DESCRIPTION OF THE EMBODIMENT

The built-in system for testing the sprinkler system of a lifeboat 1 includes the interconnected: water tank 17 and pipeline 14 for the water from the water installation of a marine facility. The water tank 17 is a fixed component of the lifeboat 1, and is fed with water from the water installation of the marine facility via a hose 11. The pipeline 14 for the water from the water installation of the marine facility has a valve 15 for the water from the water installation of the marine facility. The pipeline 14 for the water from the water installation of the marine facility is connected to an outboard water inlet pipe 4 of the sprinkler system, which pipe has an outboard water valve 5.

Via the outboard water inlet pipe 4 of the sprinkler system, outboard water is fed to the sprinkler system pump 2 after the lifeboat 1 has been launched. The purpose of the pipeline 14 for the water from the water installation of the marine facility 14 is to feed the water from the water installation of the marine facility to the sprinkler system pump 2 while a test of the operation of the lifeboat's sprinkler system is being carried out in a situation where the lifeboat 1 is located at the marine facility.

The top wall 20 of the water tank 17 is a part of the hull plating 10 of the lifeboat 1, and is openable. The lowest point 19 of the bottom 18 of the water tank 17 is connected to the pipeline 14 for the water from the water installation of the marine facility. The water tank 17 is located within the lifeboat 1 in such a way that its top wall 20 is below the point 9 that connects the internal pipeline 6 of the sprinkler system to the external pipeline 7 of the sprinkler system that has sprinkler nozzles 8, and bottom 18 is located above: the sprinkler system pump 2, the outboard water inlet pipe 4 of the sprinkler system, and the pipeline 14 for the water from the water installation of the marine facility. At the connection point 16, the pipeline 14 for the water from the water installation of the marine facility is connected to the outboard water inlet pipe 4 of the sprinkler system. The connection point 16 that connects the pipeline 14 for the water from the water installation of the marine facility to the outboard water inlet pipe 4 of the sprinkler system is located between the outboard water valve 5 of the outboard water inlet pipe 4 of the sprinkler system and the sprinkler system pump 2.

Preparation of the sprinkler system of the lifeboat 1 for carrying out the test involves opening the top wall 20 of the water tank 17. The hose 11 gets connected to the connector 13 of the marine facility's water installation valve 12, and, with its help, the tank 17 gets filled with water.

After opening the marine facility's water installation valve 12, water fills the tank 17, and the excess water is able to overflow. The actions of opening the valve 15 for the water from the water installation of the marine facility and starting the sprinkler system pump 2 enable the water from the tank 17 to flow to the sprinkler system pump 2. Operation of the sprinkler system pump 2, while valve 15 is open and water resides in tank 17, feeds the sprinkler nozzles 8 with water. Stopping the sprinkler system pump 2, opening the outboard water valve 5, and closing the water installation valve 12 of the marine facility enables water to flow out through the inlet opening 3 for outboard water, and results in removal of water from the sprinkler system, and from the system for testing the sprinkler system, which makes it possible to complete the evaluation of the proper operation of the lifeboat's 1 sprinkler system.

After carrying out a test of the operation of the lifeboat's 1 sprinkler system, if the test has been carried out using seawater, filling the tank 17 with fresh water allows to flush the lifeboat's 1 sprinkler system with fresh water. If it is possible to feed tank 17 with fresh water during the test, this offers the possibility of carrying out the test using fresh water.

An advantage of the disclosed embodiment is the capability of confirming the proper operation of the sprinkler system of a lifeboat without having to launch the lifeboat. Moreover, after the operation of the lifeboat's sprinkler system has been tested using sea water in a situation where the lifeboat is located at the marine facility, the disclosed embodiment provides the capability of flushing the lifeboat's sprinkler system with fresh water. Furthermore, disclosed embodiment provides the capability of testing the operation of a lifeboat's sprinkler system using fresh water in a situation where the lifeboat is located at the marine facility. Seawater contains chemical compounds, such as chlorides including sodium chloride. Chlorides in contact with the sprinkler system and its surroundings may clog the sprinkler system with salt crystals as a result of the petrification and hydration processes, accelerate corrosion of metal components such as the moving links and wire ropes of the lifeboat's launching system or the deck of the marine facility, and destroy plastic components such as the outer surface and any rubber seals of the lifeboat's hull.

LIST OF DESIGNATIONS

1—lifeboat
2—sprinkler system pump
3—inlet opening
4—outboard water inlet pipe of the sprinkler system
5—outboard water valve
6—internal pipeline of the sprinkler system
7—external pipeline of the sprinkler system
8—sprinkler nozzle
9—connecting point
10—hull plating
11—hose
12—water installation valve
13—valve connector for connecting to the hose
14—pipeline for the water from the water installation of the marine facility
15—valve for the water from the water installation of the marine facility
16—connection point
17—water tank
18—bottom of the water tank
19—lowest point of the bottom
20—top wall of the water tank

The invention claimed is:

1. A lifeboat (1) having a sprinkler system and a built-in system for testing the sprinkler system, the built-in system for testing the sprinkler system comprising:
- a water tank (17);
- a water tank pipeline (14);
- a tank valve (15);
- an outboard water valve (5);
- an outboard water inlet pipe (4); and
- sprinkler system pump (2);
- wherein one end of the outboard water inlet pipe (4) comprises an inlet opening for receiving outboard water from a water installation of a marine facility;
- wherein the other end of the outboard water inlet pipe (4) connects to outboard water valve (5);
- wherein one end of the water tank pipeline (14) connects to the water tank (17);
- wherein the other end of the water tank pipeline (14) connects to the tank valve (15);
- wherein a passage from tank valve (15) and a passage from outboard water valve (5) communicate with an inlet of the sprinkler system pump (2).

2. The lifeboat of claim 1, wherein the water tank (17) has a has a water tank top wall (20), and the water tank top wall (20) forms part of a hull plating (10) of the lifeboat.

3. The lifeboat of claim 1 wherein the water tank (17) has a water tank top wall (20), and the water tank (17) is designed so that the water tank top wall (20) is openable.

4. The lifeboat of claim 1, wherein the water tank (17) has a bottom (18) having a lowest point, wherein the one end of the water tank pipeline (14) that connects to the water tank (17), connects to the water tank (17) at the lowest point of the bottom (18) of the water tank (17).

5. The lifeboat of claim 1:
- wherein the sprinkler system comprises an internal pipeline (6);
- wherein the sprinkler system comprises an external pipeline (7);
- wherein the water tank comprises a water tank top wall (20);
- wherein one end of the internal pipeline (6) connects to an outlet of sprinkler system pump (2), and the other end of the internal pipeline (6) is located at a connecting point (9) where the internal pipeline (6) connects to the external pipeline (7); and
- wherein the connecting point (9) is above the water tank top wall (20).

6. The lifeboat of claim 1:
- wherein the water tank (17) has a water tank bottom (18);
- the water tank bottom (18) is located above the sprinkler system pump (2);
- the water tank bottom (18) is located above the outboard water inlet pipe (4); and
- the water tank bottom (18) is located above the water tank pipeline (14).

* * * * *